US005952592A

United States Patent [19]

Teel

[11] Patent Number: 5,952,592

[45] Date of Patent: Sep. 14, 1999

[54] ACOUSTIC GUITAR ASSEMBLY

[75] Inventor: Timothy A. Teel, Lehighton, Pa.

[73] Assignee: C.F. Martin & Company, Inc., Nazareth, Pa.

[21] Appl. No.: 09/111,102

[22] Filed: Jul. 6, 1998

[51] Int. Cl.[6] ..... G10D 3/00

[52] U.S. Cl. ..... 84/291; 84/267

[58] Field of Search ..... 84/267, 291

[56] References Cited

U.S. PATENT DOCUMENTS

| | | | |
|---|---|---|---|
| 3,474,697 | 10/1969 | Kaman . | |
| 3,656,395 | 4/1972 | Kaman . | |
| 3,685,385 | 8/1972 | Rendell . | |
| 3,892,159 | 7/1975 | Houtsma . | |
| 3,974,730 | 8/1976 | Adams, Jr. . | |
| 4,079,654 | 3/1978 | Kasha . | |
| 4,084,475 | 4/1978 | Horowitz . | |
| 4,178,827 | 12/1979 | Mallory . | |
| 5,406,874 | 4/1995 | Witchel . | |
| 5,461,958 | 10/1995 | Dresdner et al. | 84/267 |

*Primary Examiner*—William M. Shoop, Jr.
*Assistant Examiner*—Shih-yung Hsieh
*Attorney, Agent, or Firm*—Howson and Howson

[57] ABSTRACT

An acoustic guitar having a resin laminate soundboard with a bracing pattern specifically configured to provide the non-wooden soundboard with qualitites resembling traditional wooden soundboards. The soundboard is made from a relatively inexpensive resin laminate material in order to reduce the manufacturing cost of the acoustic guitar. The bracing pattern located on the underside of the soundboard stiffens the non-wooden soundboard at particular locations in order to permit a required degree of vibration for acoustic purposes while preventing damaging flexure caused by the forces of the tensioned guitar strings.

20 Claims, 3 Drawing Sheets

ACOUSTIC GUITAR ASSEMBLY

FIELD OF THE INVENTION

The present invention relates to an acoustic guitar, and more particularly, the present invention relates to an acoustic guitar soundboard which is constructed of sheets of synthetic resin laminates and which has a unique bracing structure.

BACKGROUND OF THE INVENTION

A typical acoustic guitar has a hollow body connected to a neck. The hollow body has a soundboard with a soundhole, a backboard spaced from the soundboard, and a shaped sidewall which connects between the soundboard and backboard. Typically, these components are constructed of choice pieces of wood in order to produce instruments of superior quality.

The acoustic guitar has a series of strings strung at substantial tension from a bridge on the soundboard, across the soundhole, and along the neck. The string tension creates forces which act on the soundboard and which, over time, can cause bending, cracking or other damage to the soundboard. The damage can result in structural failure and altered intonation of the acoustic guitar.

In high quality acoustic guitars, the soundboard must be capable of sufficient vibration to provide superior acoustic performance while being sufficiently rigid so that it withstands the forces created by the tensioned strings. These requirements are at cross-purposes, and heretofore have been very difficult to achieve, particularly when the soundboard is constructed from a material other than choice wooden materials.

Prior art designs have attempted to improve upon the strength and durability of acoustic guitars without adversely affecting its playing qualities. For example, U.S. Pat. No. 5,461,958 issued to Dresdner et al. and assigned to the assignee of the present application discloses an acoustic guitar assembly having a wooden soundboard with an improved soundboard bracing structure and an improved neck to body joint.

Prior art designs have also attempted to construct an acoustic guitar from relatively inexpensive, non-wooden materials. For example, U.S. Pat. No. 5,406,874 issued to Witchel discloses a stringed instrument having a hollow body constructed of sheets of synthetic resin laminates, such as, melamine impregnated resins impressed over phenolic craft layers.

Therefore, although the above-mentioned acoustic guitar assemblies accomplish their intended purposes, there is a need for a high quality, durable acoustic guitar which is constructed from inexpensive materials. In particular, the soundboard should be made of a non-wooden material which is capable of vibrating and providing superior acoustic performance and which is capable of withstanding the forces created by the tensioned strings.

OBJECTS OF THE INVENTION

With the foregoing in mind, a primary object of the present invention is to provide a high quality acoustic guitar which can be manufactured economically relative to traditional acoustic guitar models.

Another object of the present invention is to provide an acoustic guitar with a soundboard constructed of a relatively inexpensive, non-wooden material which does not adversely affect the tonal qualities of the guitar.

A further object of the present invention is to provide an acoustic guitar with a unique soundboard bracing pattern specifically designed for use on a non-wooden soundboard so that the guitar provides acoustics comparable to the acoustics provided by a traditional acoustic guitar having a wooden soundboard.

SUMMARY OF THE INVENTION

More specifically, the present invention provides an acoustic guitar having a body with a soundboard, a backboard spaced from the soundboard, a sidewall extending between and connecting the soundboard and backboard, and a neck extending from the body sidewall. The soundboard has a soundhole and is made of synthetic resin laminate sheets. The improvement comprises a pattern of bracing located on the underside of the soundboard.

The bracing pattern includes an X-brace having four legs defining four quadrants on the soundboard. The soundhole and neck are located in a first quadrant. A pair of X-brace legs extend adjacent the soundhole opposite from the neck of the acoustic guitar, and a pair of the legs extend in a direction opposite the neck of the guitar. The bracing pattern includes an A-brace also located in the first quadrant on the soundboard between the soundhole and the neck. The A-brace cooperates with the X-brace to completely surround the soundhole.

The bracing pattern further includes a flat, trapezoidal-shaped bridge plate. The bridge plate is located in a quadrant opposite from the neck and has a pair of non-parallel edges which confront a pair of the X-brace legs. V-Shaped tone bars are also included in the quadrant opposite the neck to prevent "bellying" of the soundboard. A pair of triangular flat side panels are located in lateral quadrants on the soundboard between the soundhole and the bridge plate. Each side panel confronts two of the X-brace legs.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
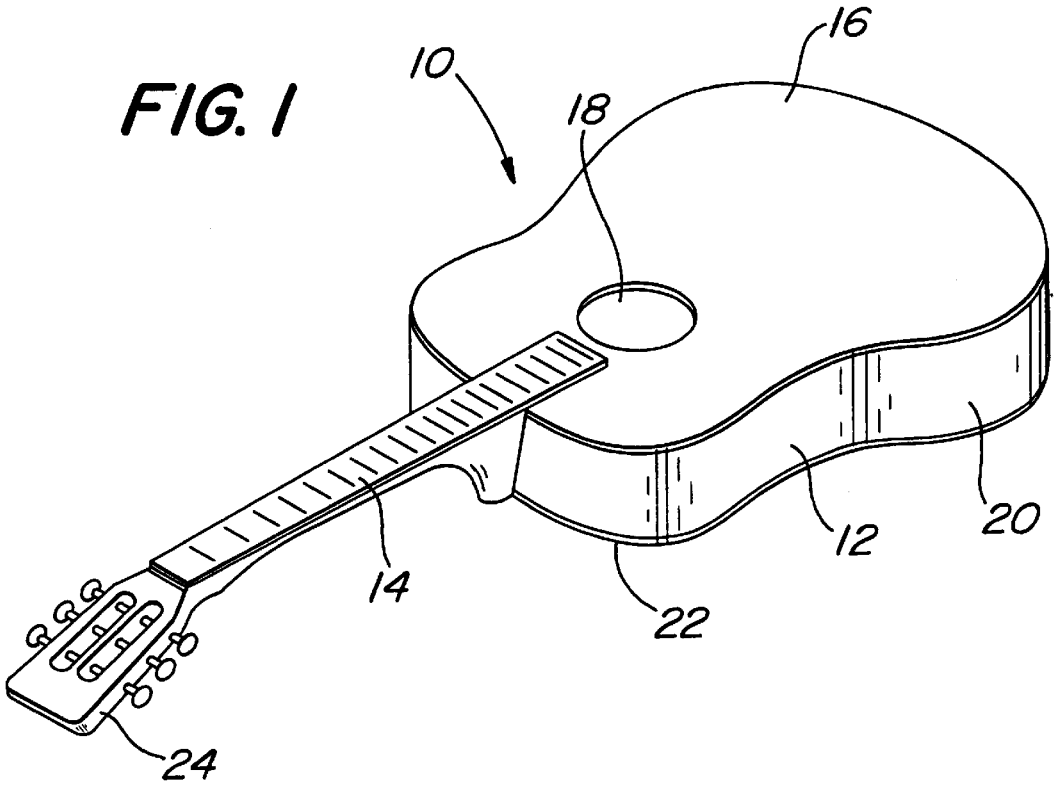
FIG. 1 is a perspective view of an acoustic guitar according to the present invention.
Figure 2:
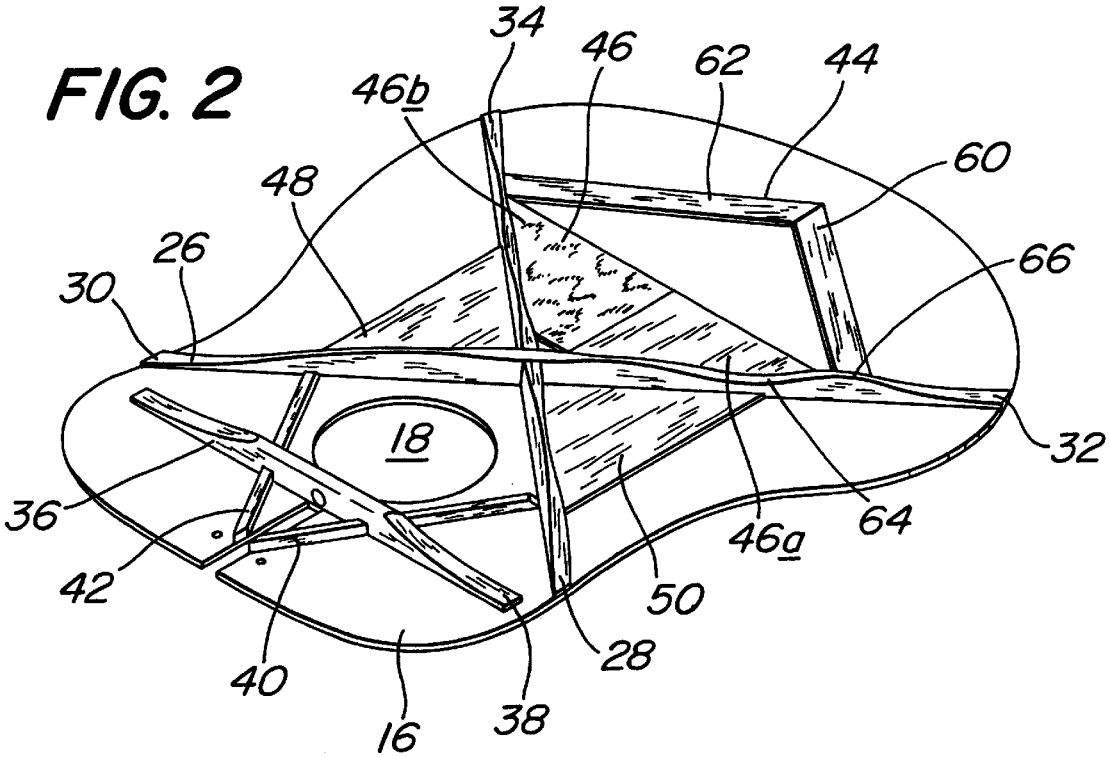
FIG. 2 is a perspective view of an underside of a soundboard of the acoustic guitar according to the present invention.

Referring now to the drawings, FIG. 1 illustrates an acoustic guitar 10 having a hollow body 12 and a neck 14. The body has a soundboard 16 with a circular soundhole 18. The soundboard 16 is connected to sidewall 20 which, in turn, is connected to a backboard 22. The neck 14 has a headstock 24, and strings (not shown) are strung from the headstock 24 in a direction along the neck 14, across the soundhole 18 and to a bridge (not shown) on the soundboard 16.

An important aspect of the present invention is that the soundboard 16, backboard 22 and sidewall 20 are constructed of sheets of synthetic resin laminates, preferably, melamine impregnated resins impressed over phenolic craft layers, so that the acoustic guitar 10 is capable of being manufactured economically in relative comparison to acoustic guitars manufactured completely of wooden materials. The previously discussed prior art, U.S. Pat. No. 5,406,874 issued to Witchel, discloses an acoustic guitar having a soundboard manufactured from sheets of melamine. The disclosure provided by U.S. Pat. No. 5,406,874 issued to Witchel is incorporated herein by reference.

In combination with the soundboard being constructed of the above-referenced, non-wooden material, the present invention also provides a unique bracing pattern specifically designed for use on such a soundboard to provide the acoustic guitar 10 with durability and acoustic quality. As noted previously, the tension created by the strings of the guitar can cause damage to the soundboard 16, particularly in a region adjacent the soundhole 18. In addition, if the soundboard is permitted to "lift up" or "belly", then the height of the strings moves away from the neck making the guitar increasingly more difficult to play. Thus, in order to reinforce the soundboard 16, bracing is secured to the underside of the soundboard. The bracing must prevent "bellying" ; however, it should not over-stiffen the soundboard and deaden the acoustics.

The bracing pattern of the present invention utilizes an X-brace 26, an A-brace 36, V-shaped tone bars 44, a bridge plate 46 and side support panels, 48 and 50. All are made from choice pieces of wood having a predetermined density and thickness and a grain aligned in a predetermined direction relative to the strings of the guitar. All are glued to the underside of the soundboard 16, and each will be discussed in detail below.

The X-brace 26 and the A-brace 36 are provided to completely encompass the soundhole 18 and support the area of the soundboard 16 adjacent the soundhole 18. This support prevents cracking, or extreme bending, of the soundboard 16 between the soundhole 18 and the outer peripheral edge of the guitar 10. The previously discussed prior art, U.S. Pat. No. 5,461,958 issued to Dresdner et al., discloses an acoustic guitar having an X-brace and an A-brace. The disclosure provided by U.S. Pat. No. 5,461,958 issued to Dresdner et al. is incorporated herein by reference.

Figure 3:
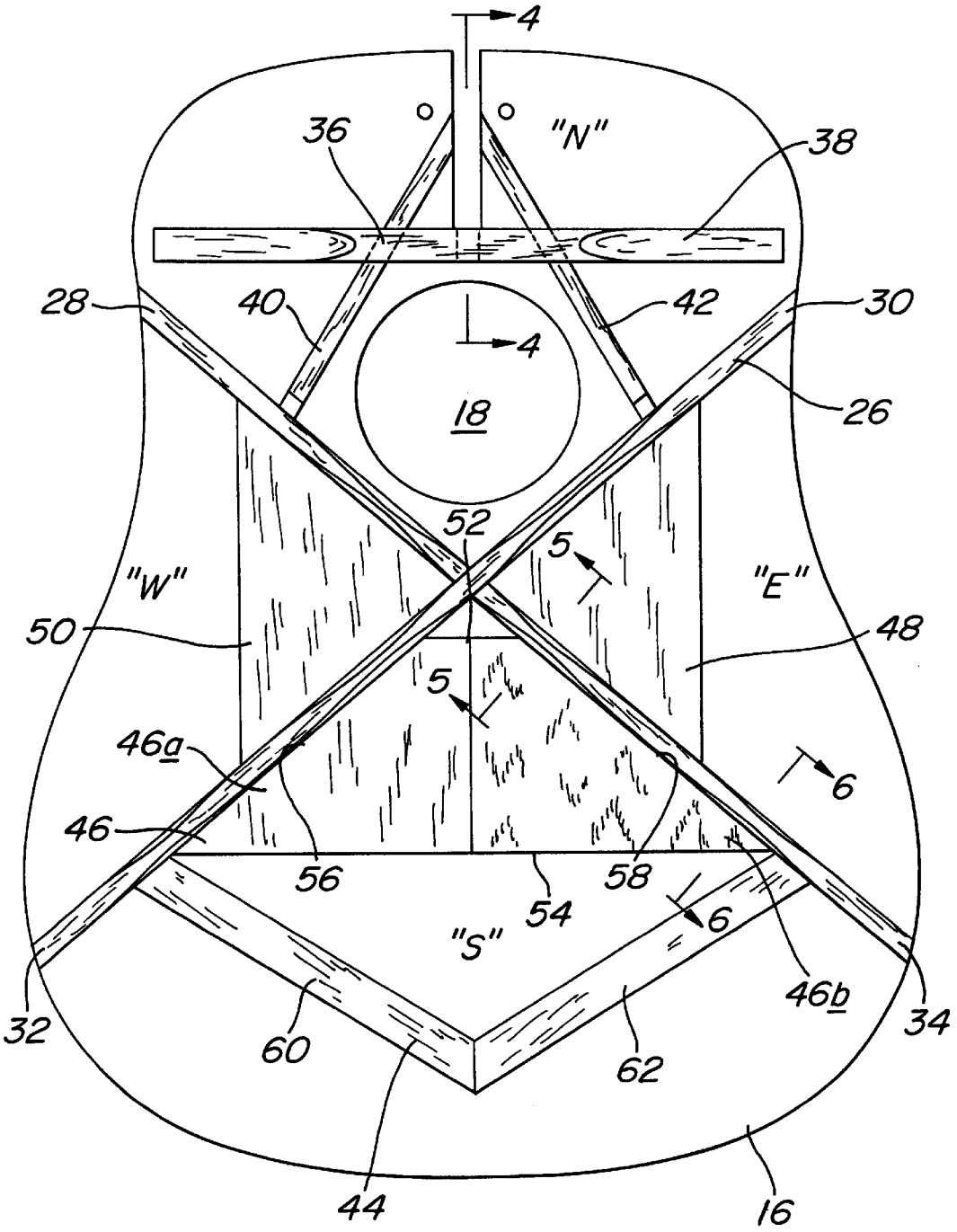
FIG. 3 is plan view of the soundboard underside illustrated in FIG. 2.
Figure 4:
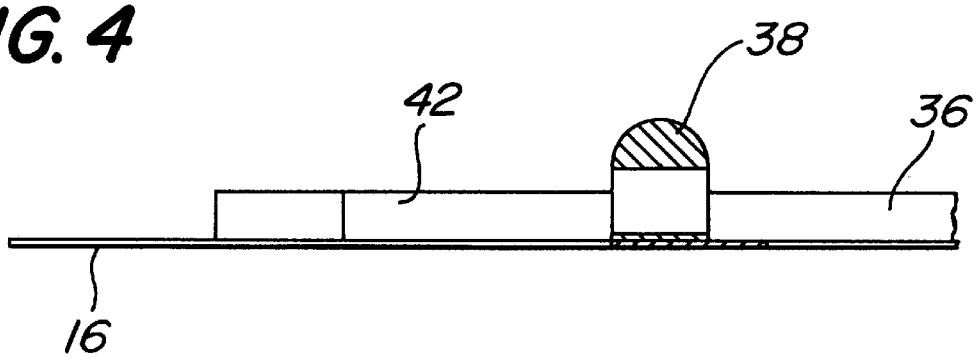
FIG. 4 is an elevational cross-section view of the soundboard illustrated in FIG. 3 along the line 4—4.

As best illustrated in FIG. 3, the X-brace 26 extends across a substantial portion of the underside of the soundboard 16 and has four upstanding, shaped legs, 28, 30, 32, and 34. As illustrated in FIG. 3, the legs 28 and 30 of the X-brace 26 define a first, or northernmost, quadrant "N", and the legs 32 and 34 define an opposite, or southernmost, quadrant "S". Side quadrants, "E" and "W", are defined by legs 30 and 34 and legs 28 and 32, respectively. The soundhole 18 is located within the northern quadrant "N" and is structurally supported by legs 28 and 30 of the X-brace 26. The area of the soundboard 16 furthest from the neck 14 is supported by legs 32 and 34 of the X-brace.

The A-brace 36 extends in the northern quadrant "N" across the portion of the soundboard 16 between the legs 28 and 30 of the X-brace 26 and the neck 14. The A-brace 36 has three legs 38, 40 and 42 which structurally support the area of the soundboard adjacent the soundhole 18 and neck 14. The leg 38 extends transversely of the soundboard 16 and neck 14 between the soundhole 18 and neck 14. The transverse leg 38 is notched to secure the legs 40 and 42 to the underside of the soundboard. The A-brace 36 also provides structural support for the neck to body joint as disclosed in the previously mentioned Dresdner et al. patent.

The uniquely designed flat bridge plate 46 is located in the southern quadrant "S" on the underside of the soundboard 16 opposite the location of the bridge (not shown) of the guitar. The bridge is located on the topside of the soundboard 16 and is used to connect the strings to the hollow body 12. The bridge plate 46 is constructed of a separate bass plate **46*a* and a separate treble plate 46*b* which combine to provide a trapezoid-shape. The trapezoid-shaped bridge plate has a pair of parallel edges, 52 and 54, which are positioned substantially transverse to the strings of the guitar and which extend between legs 32 and 34 of the X-brace. The trapezoid-shaped bridge plate 46 has a pair of non-parallel edges, 56 and 58, which confront the legs 32 and 34**.

The bass plate **46*a* is preferably made of rosewood to stimulate response to bass notes produced by the adjacent strings of the guitar, and the treble plate 46*b*** is preferably made of genuine mahogany to stimulate response to treble notes produced by the adjacent strings of the guitar.

As best illustrated in FIG. 3, the grains of the bridge plate 46 extend in a direction substantially parallel with the guitar strings. This positioning of the grain relative to the direction in which the strings of the guitar are strung prevents damaging flexure of the soundboard 16 along a direction transverse to the strings. The flat bridge plate 46 is preferably about 0.125 inch thick. The thickness of the bridge plate is critical in that an overly thick plate deadens the acoustics of the guitar, and a plate which is too thin permits unwanted and potentially damaging bending of the soundboard 16 due to the tensioned strings.

The left and right side panels, 48 and 50, are located in quadrants "E" and "W", respectively, and stiffen a region of the soundboard 16 between the soundhole 18 and the bridge. As illustrated, each is substantially flat, about 0.100 of an inch thick, and triangular in plan. The side panel 48 confronts and extends between the legs 30 and 34 of the X-brace 26, and the side panel 50 confronts and extends between the legs 28 and 32 of the X-brace 26. The side plates, 48 and 50, are preferably made of a vertically grained spruce, such as a Sitka spruce, and their grain is aligned in a direction substantially parallel to the strings of the guitar to provide greater support against soundboard bending in a direction transverse to the strings.

The V-shaped tone bars, or so-called "bottom bout supports", 44, which are located in quadrant "S", supports a region of the soundboard 16 adjacent the bridge opposite from the soundhole 18. This area of the soundboard is prone to so-called "bellying" which develops due to the forces created by the tensioned strings of the guitar. When the soundboard develops a "belly" in this location, it can cause the soundhole 18 to collapse. Thus, the V-shaped tone bars 44 reinforce and stiffen the soundboard to control the amount of bellying and prevent collapse of the soundhole. To this end, the V-shaped tone bars 44 include two flat leg plates, 60 and 62, which confront and extend from the legs, 32 and 34, of the X-brace 26 and converge adjacent a peripheral edge of the soundboard 16 remote from the neck 14. The legs, 60 and 62, of the V-shaped tone bars 44 are preferably made of two strips of spruce and have a thickness of about 0.100 inches.

Figure 5:
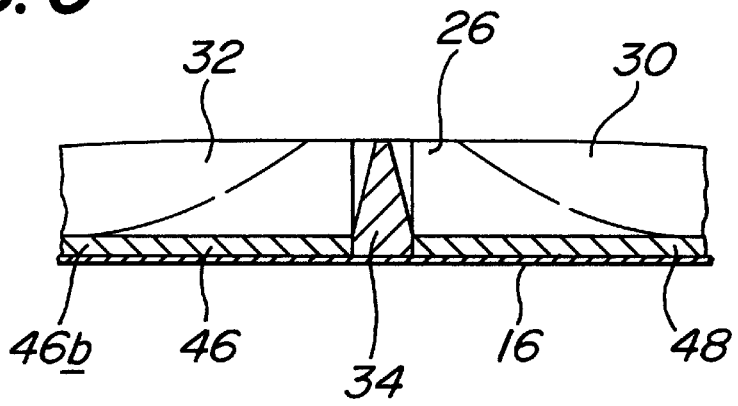
FIG. 5 is an elevational cross-section view of the soundboard illustrated in FIG. 3 along the line 5—5.
Figure 6:
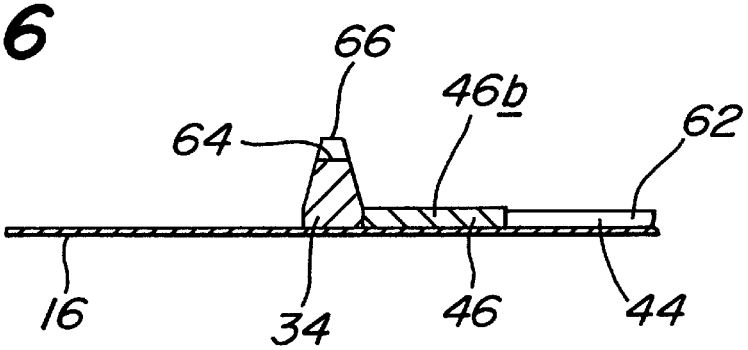
FIG. 6 is an elevational cross-section view of the soundboard illustrated in FIG. 3 along the line 6—6.

As best illustrated in FIGS. 5 and 6, the legs, 32 and 34, of the X-brace 26 have a scalloped-shape in strategic locations where the legs confront the bridge plate 46 and the V-shaped tone bars 44. The tapered legs, 32 and 34, are sculptured with a valley 64 where they confront the bridge plate 46 and extend to a peak 66 where they confront the V-shaped tone bar 44. These shapes permit maximum vibration without reducing their required strength.

The structural features described facilitate ready manufacture in addition to providing the desired strength enhancement. Except as noted, the guitar is assembled and glued together using conventional materials. The neck 14 and headstock 24 are made of conventional wooden materials.

While a preferred embodiment of an acoustic guitar has been described, various modifications, alterations, and changes may be made without departing from the spirit and scope of the present invention as defined in the appended claims.

I claim:

1. In an acoustic guitar having a body with a soundboard, a backboard spaced from the soundboard, a sidewall extending between and connecting the soundboard and backboard, and a neck extending from the body sidewall, the soundboard having a soundhole and an underside, and the soundboard, backboard and sidewall being made of synthetic resin laminate sheets, the improvement comprising a pattern of bracing located on the underside of the soundboard, said bracing pattern including:

an X-brace having four legs defining four quadrants on the soundboard, a pair of said X-brace legs define a first quadrant in which the soundhole and neck are located, and the other pair of said X-brace legs define an opposite quadrant on the soundboard remote from the neck of the guitar;

an A-brace located in said first quadrant on the soundboard between the soundhole and the neck, said A-brace cooperating with said X-brace to completely surround the soundhole; and a flat, trapezoidal-shaped bridge plate located in said opposite quadrant and having a pair of non-parallel edges which confront portions of said X-brace legs in said opposite quadrant, said bridge plate being constructed of a separate base plate and a separate treble plate, said base plate being made of a material which stimulates a response to base notes and said treble plate being made of a material which stimulates a response to treble notes.

2. The acoustic guitar according to claim 1, wherein said base plate is made of rosewood and said treble plate is made of genuine mahogany.

3. The acoustic guitar according to claim 2, wherein said bridge plate has a grain which is aligned in a direction substantially parallel with the neck of the guitar.

4. The acoustic guitar according to claim 1, further comprising a pair of triangular flat side panels located on the soundboard between the soundhole and said bridge plate, each side plate confronting two of said X-brace legs.

5. The acoustic guitar according to claim 4, wherein said side panels are made of spruce.

6. The acoustic guitar according to claim 5, wherein said side panels have a grain which is aligned in a direction substantially parallel with the neck of the guitar.

7. The acoustic guitar according to claim 1, further comprising V-shaped tone bars located in said opposite quadrant and having ends confronting a portion of two of said X-brace legs.

8. The acoustic guitar according to claim 7, wherein said V-shaped tone bars are located a spaced distance from said bridge plate on a side of said bridge plate remote from the soundhole.

9. The acoustic guitar according to claim 8, wherein said pair of X-brace legs defining said opposite quadrant have a scalloped shape.

10. The acoustic guitar according to claim 9, wherein said scalloped-shaped X-brace legs are formed with a valley where they confront said bridge plate and a peak where they confront said V-shaped tone bars.

11. In an acoustic guitar having a body with a soundboard, a backboard spaced from the soundboard, a sidewall extending between and connecting the soundboard and backboard, and a neck extending from the body sidewall, the soundboard having a soundhole and an underside and being made of synthetic resin laminate sheets, the improvement comprising a pattern of bracing located on the underside of the soundboard, said bracing pattern including:

an X-brace having four legs defining four quadrants on the soundboard, a pair of said X-brace legs define a first quadrant in which the soundhole and neck are located, and the other pair of said X-brace legs define an opposite quadrant on the soundboard remote from the neck of the guitar;

an A-brace located in said first quadrant on the soundboard between the soundhole and the neck, said A-brace cooperating with said X-brace to completely surround the soundhole; and a pair of triangular flat side panels located on the soundboard between the soundhole and said opposite quadrant, each side plate confronting two of said X-brace legs.

12. The acoustic guitar according to claim 11, wherein said side panels are made of vertically grained spruce.

13. The acoustic guitar according to claim 12, wherein said side panels have a grain which is aligned in a direction substantially parallel with the neck of the guitar.

14. The acoustic guitar according to claim 11, further comprising V-shaped tone bars located in said opposite quadrant and having ends confronting a portion of two of said X-brace legs.

15. The acoustic guitar according to claim 14, further comprising a flat, trapezoidal-shaped bridge plate located in said opposite quadrant and having a pair of non-parallel edges which confront portions of said X-brace legs in said opposite quadrant.

16. The acoustic guitar according to claim 15 wherein said V-shaped tone bars are located a spaced distance from said bridge plate on a side of said bridge plate remote from the soundhole.

17. In an acoustic guitar having a body with a soundboard, a backboard spaced from the soundboard, a sidewall extending between and connecting the soundboard and backboard, and a neck extending from the body sidewall, the soundboard having a soundhole and an underside, and the soundboard, backboard and sidewall being made of synthetic resin laminate sheets, the improvement comprising a pattern of bracing located on the underside of the soundboard, said bracing pattern including:

an X-brace having four legs defining four quadrants on the soundboard, a pair of said X-brace legs define a first quadrant in which the soundhole and neck are located, and the other pair of said X-brace legs define an opposite quadrant on the soundboard remote from the neck of the guitar;

an A-brace located in said first quadrant on the soundboard between the soundhole and the neck, said A-brace cooperating with said X-brace to completely surround the soundhole;

a flat, trapezoidal-shaped bridge plate located in said opposite quadrant and having a pair of non-parallel edges which confront portions of said X-brace legs in said opposite quadrant;

a pair of triangular flat side panels located on the soundboard between the soundhole and said bridge plate, each side plate confronting two of said X-brace legs; and V-shaped tone bars located in said opposite quadrant and having ends confronting a portion of two of said X-brace legs.

18. The acoustic guitar according to claim 17, wherein said V-shaped tone bars are located a spaced distance from said bridge plate on a side of said bridge plate remote from the soundhole.

19. The acoustic guitar according to claim 18, wherein said bridge plate is constructed of a separate base plate and a separate treble plate, said base plate being made of a material which stimulates a response to base notes and said treble plate being made of a material which stimulates a response to treble notes.

20. The acoustic guitar according to claim 19, wherein said side panels and said V-shaped tone bars are made of Sitka spruce.

* * * * *